United States Patent [19]

Lyssy

[11] 4,359,997

[45] Nov. 23, 1982

[54] FIXED BLADE TURBULENCE GENERATOR

[75] Inventor: Norbert G. Lyssy, Utopia, Tex.

[73] Assignee: Harry D. Vaughn, Vanderpool, Tex.

[21] Appl. No.: 219,969

[22] Filed: Dec. 24, 1980

[51] Int. Cl.[3] ..... F02M 29/02

[52] U.S. Cl. ..... 123/592; 123/306; 123/188 M; 261/79 R; 48/180 S

[58] Field of Search ..... 123/590, 591, 593, 188 M, 123/592, 306; 261/79 R; 48/180 R, 180 S

[56] References Cited

U.S. PATENT DOCUMENTS

| | | | |
|---|---|---|---|
| 1,526,963 | 2/1925 | Chandler | 123/188 M |
| 3,437,467 | 4/1969 | Jacobus | 123/590 |
| 3,747,581 | 7/1973 | Kolb | 123/593 |
| 3,857,375 | 12/1974 | Jackson | 123/590 |
| 3,938,967 | 2/1976 | Reissmüller | 123/590 |
| 4,038,950 | 8/1977 | Konomi et al. | 123/188 M |
| 4,088,103 | 5/1978 | Brown | 123/593 |
| 4,092,966 | 6/1978 | Prosen | 123/590 |
| 4,187,819 | 2/1980 | Longobardi | 123/590 |

FOREIGN PATENT DOCUMENTS

| | | | |
|---|---|---|---|
| 550807 | of 1956 | Italy | 123/590 |
| 52-31212 | of 1977 | Japan | 123/188 M |
| 55-25532 | of 1980 | Japan | 123/188 M |
| 391535 | of 1933 | United Kingdom | 123/590 |
| 532985 | of 1941 | United Kingdom | 123/188 M |
| 1184525 | of 1970 | United Kingdom | 123/188 M |

*Primary Examiner*—Charles J. Myhre
*Assistant Examiner*—E. Rollins Cross
*Attorney, Agent, or Firm*—Gunn, Lee & Jackson

[57] ABSTRACT

A device and method for installing a device for improving the fuel/air mixture in internal combustion engines with or without a fuel injection system. An intermediate member operatively dispositioned between the engine intake manifold and the intake port comprises at least two helically twisted blades attached to the inner bore of an intake port opening in the intermediate member; these blades are angled in relation to the fuel/air flow path and twisted so as to impart a swirling to the fuel-/air mixture. In fuel injected systems, the swirl is imparted to the air flow just prior to encountering the umbrella mist injected to the intake port by the fuel injector. The swirl mixing of the fuel/air improves engine performance, reduces pollutants, and increases gas mileage. Further, in fuel injection systems, the device reduces or eliminates the common occurrence of a burned intake valve caused by a clogged injector.

10 Claims, 7 Drawing Figures

FIXED BLADE TURBULENCE GENERATOR

BACKGROUND OF THE INVENTION AND PRIOR ART

With recent efforts to increase the fuel efficiency of the internal combustion engine, numerous devices have been developed to provide a better vaporization and mixing of the fuel/air combustion mixture to improve engine operation as well as to improve fuel consumption. In the internal combustion engine, the engine requires large volumes of air to be mixed with the fuel and introduced into the combustion cylinder of the engine. The actual mixing of the fuel and air occurs within the carburetor. Such mixture must then flow from the carburetor through the intake manifold and be distributed to the individual cylinders of the engine.

In some cases the fuel which reliquifies on the intake manifold walls is not thoroughly mixed when it enters the intake port and combustion cylinder. Without complete mixing there is a reduction in engine efficiency, and an increase in exhaust pollutants. Numerous devices have been developed to improve mixing. Devices of this type are shown in U.S. Pat. Nos. 4,177,780; 4,094,291; 4,092,966; 4,015,574; 3,938,967; and 3,815,565. However, these devices are located in the fuel/air flow path between the carburetor and the intake manifold. Because these devices are located upstream from the intake valve, the turbulence generated by such devices is significantly reduced upon reaching the intake valve. Further, devices upstream from the intake manifold are not effective in creating turbulence for mixing fuel injected in fuel injection-type engines.

In fuel injection systems, injectors are designed to deliver an "umbrella" pattern of fuel mist before entering the combustion cylinder. Because all fuels have certain quantities of insoluable, solid impurities, small particles of debris make their way into the injectors, causing them to become partially clogged. Plugging of the injector changes the "umbrella" to a stream, or series of streams, which act as cutting torches, actually eroding the head of the cylinder intake valve.

Thus, devices such as that disclosed in U.S. Pat. No. 4,092,966, could not be utilized to create any turbulence to mix and effectively break up the fuel stream discharging from a plugged injector. Devices upstream of the intake port cannot improve the homogenity of the fuel and air mixture in fuel injection engines.

SUMMARY OF THE INVENTION

The present invention is directed to a device located at the intake port at the junction of the intake manifold and the engine head. This location allows the device to be used with any type of carburetor or fuel injection system.

It is the object of the present invention to utilize at least two fixed, helically twisted blades to impart additional swirl mixing of the fuel/air mixture. The strategic location of the invention in the flow path creates the violent swirl of the fuel/air mixture immediately before and as the mixture enters the combustion cylinder. This fuel/air mixture has already been pre-heated by its travel through the intake manifold. The "violent swirl" created by the device provides a more uniform fuel/air mixture, thereby causing a more complete and efficient combustion. The overall result of using the device is better gas mileage, increased performance, easier starting, and less pollution.

It is another object of the present invention to improve the fuel/air mixture of the fuel injected engines, preventing valves from being burned or eroded by clogged injectors. As a result of forcing the air to enter the intake port in a high velocity swirl, there is disruption of any direct fuel streams upon the head of the cylinder intake valve which occur as a result of clogged injectors.

Additionally, it is an object of the present invention that the present invention may be easily fabricated as a part of the intake manifold gasket, as an intake manifold alignment ring, or as an insert for a modified intake manifold gasket. The device requires no modification to the basic combustion engine. The configuration and size of the invention will vary according to the type of intake opening found in the various four-cycle internal combustion engines, whether one cylinder or more, whether in-line, opposed, V-type, or radial engines.

Another object of the present invention is to provide a device that improves the homogeneity of the fuel/air mixture delivered by the carburetor to the cylinders of an internal combustion engine with little or no obstruction in the mixture flow resulting in no starving of the engine.

Another object to deliver the fuel/air mixture to the center of the cylinder for a uniform flame front. The swirling mixture delivered by the present invention results in cleaner, more-efficient combustion.

It is a further object of the present invention to provide a method for retro-fitting existing internal combustion engine, with or without fuel injection systems, to incorporate the present invention for improved fuel/air mixing.

DESCRIPTION OF THE PREFERRED EMBODIMENT

Figure 1:
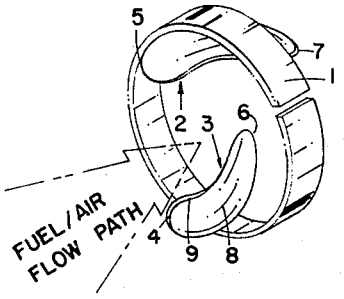
FIG. 1 is a perspective view of the present invention of a fixed blade turbulence device as a modified split, manifold alignment ring.

As shown in FIG. 1, an embodiment of the device of the invention is represented as a modified split, manifold alignment ring 1. At least two blades or fin members 2 and 3 are securely affixed to the inner circumference of ring 1 by any conventional means such as welding. The blades are constructed of a rigid material such as stainless steel with sufficient burnell not to distort or deflect.

The blades or fins 2 and 3 are shown positioned opposite one another; however, by using a smaller sized fin the number may be increased and the fins positioned equally distant around the inner circumference of the alignment ring 1. The angle of the blades 2 and 3 in relation to the fuel/air flow path may vary between 30° (more parallel to flow path) and 60° (more perpendicular to the flow path). The preferred embodiments utilize blades set at 45°. It is to be noted that the construction of the blades or fins 2 and 3 is such to induce a swirling of the fuel/air mixture as the mixture passes over the surface of the blades 2 and 3. The swirling effect is imparted as a result of the helical twisting of the blades 2 and 3 such that the leading edges 4 and 5 are at some angle greater than 20° but less than 60° to the trailing edges 6 and 7. Therefore, taking one blade 3 as an example, as the fuel/air mixture impinges upon the leading edge 4 of blade 3, it flows along the face 8 of the blade 3, rotating about the twist and exiting off of the trailing edge 6 with the swirl imparted to the mixture.

While the description just stated indicates that the swirl would be in a clockwise direction, construction of the blades could be such as to cause a counter-clockwise swirl when such a swirl would improve the efficiency of the engine operation. As can be seen further in FIG. 1, the blade face edge 9 need not be straight, but may be structured in a partial sine wave configuration such that when two blades are opposite one another there is a larger opening for the flow of the fuel/air mixture through the device. The best results for the device have been achieved when the helical angle on the blade twist is between 35° and 55°.

Figure 2:
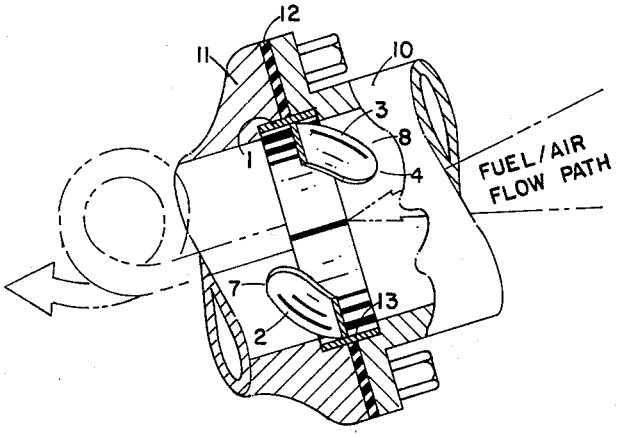
FIG. 2 is a vertical section through the junction of the intake manifold and the engine head illustrating the device of FIG. 1 functioning as a modified manifold alignment ring.

As shown in FIG. 2, the ring 1 of FIG. 1 is illustrated functioning as a modified alignment ring 1 aligning the intake manifold 10 and the engine block 11. FIG. 2 shows that no additional modification is necessary to engines which utilize such an alignment ring 1. There is no disruption of the intake manifold gasket 12 configuration normally associated with such engines. In the embodiment shown in FIG. 2, the fuel/air mixture having traveled the length of the intake manifold 10 from the carburetor impinges upon the leading edge 4 of the helically twisted blade 3. Blades 2 and 3 are securely affixed to the inner circumference 13 of the alignment ring 1. The same situation exists with the other blade 2; however, the leading edge of blade 2 is not shown in FIG. 2. As the mixture flows over the surface 8 of the blade 3, a swirl is imparted to the mixture, improving the mixing of the fuel and air. The mixture flows off the trailing edge (not shown for blade 3, but easily understood by reference to the trailing edge 7 of blade 2 shown in FIG. 2) of the blade 3 into the combustion cylinder. After initial start up of the engine, the intake manifold 10 is conductively heated through the engine block 11, causing the fuel/air mixture to be preheated prior to encountering the present invention. The swirl mixing effect imparted by the present invention to this preheated mixture improves the overall engine operation.

The method for installing the present invention requires the removal of the intake manifold, and manifold gasket, and the existing manifold alignment ring. A modified ring incorporating the structure outline in the paragraph above is then reinserted in the engine block after the intake manifold and engine head mating surfaces have been cleaned. The intake manifold gasket is reinstalled and finally the intake manifold is reinstalled. From the foregoing, it may be seen that retro-fitting existing engines can be accomplished without significant costs or labor.

Figure 3:
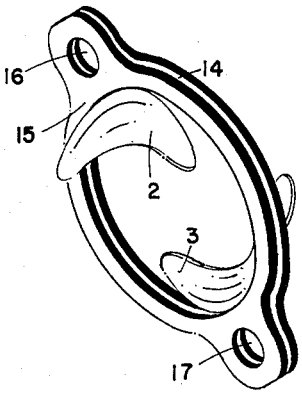
FIG. 3 is a perspective view of an alternative embodiment of the device as an intake manifold gasket for a single cylinder engine.

FIG. 3 illustrates an embodiment of the device constructed in such a way as to incorporate the features of an intake manifold gasket, readily understood by one skilled in the art, with the objects of the present invention. In FIG. 3, it can be seen that a thin metal plate 14 may be covered with gasket material 15, having suitable bores 16 and 17 to accommodate the intake manifold bolts as would be understood by those skilled in the art. Alternatively, to using gasket material 15, the thin plate 14 may be embossed. While this figure shows only two blades 2 and 3, the invention could have additional blades to yield different swirl patterns for any given engine. As in all embodiments of the present invention, the helically twisted blades 2 and 3 are securely affixed to the inner circumference of the bore 18 formed in the metal plate 14 for accommodating the passage of the fuel/air mixture flow. The blades shown in FIG. 3 are helically twisted and positioned relative to the flow path at the same angles as discussed in the paragraphs describing FIG. 1. It is envisioned that embodiments similar to that shown in FIG. 3 may be manufactured by a stamping or pressing process familiar to those knowledgeable and skilled in such arts.

As with the embodiment discussed in FIG. 2, the embodiment of FIG. 3 may be installed so as to retro-fit existing engines with or without fuel injection systems. Here again, the intake manifold is removed as is the existing intake manifold gasket. After cleaning the mating surfaces on the intake manifold and the engine head, a modified intake manifold gasket incorporating the structure outlined in the foregoing paragraph disclosing the embodiment of FIG. 3 is installed. The engine manifold is then reinstalled.

Figure 4:
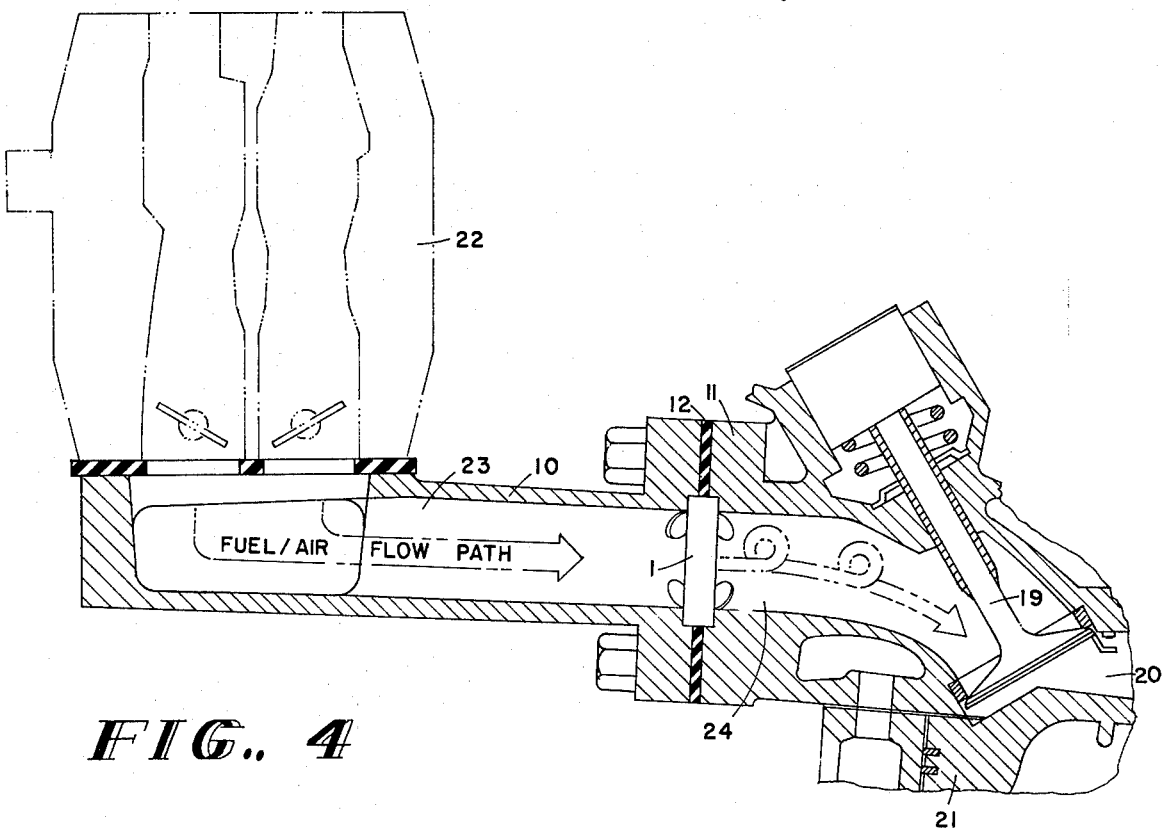
FIG. 4 is a section view showing the device in the flow line from the carburetor through the intake manifold to the engine block and cylinder intake valve.

As can clearly be seen in FIG. 4, one can easily note the positioning of the present invention in the overall flow path of the fuel/air mixture. Further, it may be observed from FIG. 4 that the present invention may be utilized with any type of carburetor 22 used with internal combustion engines. The ring 1 is positioned between the intake manifold 10 and the engine block 11 just prior to the cylinder intake valve 19. The figure also discloses the invention's position relative to the combustion cylinder 20 and piston 21. The device disclosed in FIG. 4 is similar to that indicated in FIG. 1 wherein the device is acting not only as a turbulence generator, but also as an alignment ring 1. While FIG. 4 illustrates the modified alignment ring embodiment of the invention, it should be obvious that the embodiment of FIG. 3 could be installed in engines not incorporating an alignment ring. Without any modification to the engine block 11 or the intake manifold 10, the user would simply remove the engine's normal intake manifold gasket and replace it with an embodiment similar to that shown in FIG. 4, 5 or 6.

Referring again to FIG. 4, as the fuel/air mixture flows through the intake manifold passage 23, it tends to re-liquify. When the mixture encounters the present invention 1, the violent swirl created tends to re-atomize the mixture, thus improving the combustion capability of the mixture. FIG. 4 shows that the swirl imparted to the mixture as a result of the present invention that occurs in the intake port 24 and just as the mixture enters the cylinder 20, via the intake cylinder valve 19.

Figure 5:
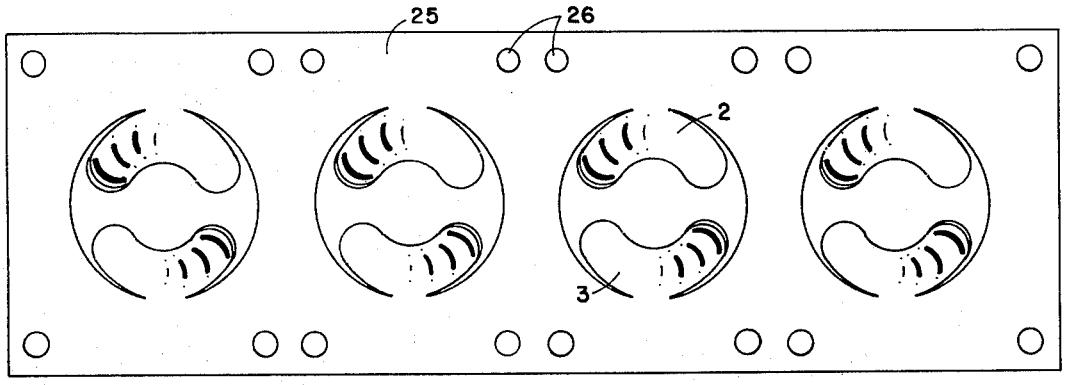
FIG. 5 is a plan view of an embodiment of the device as a four cylinder manifold gasket.

In FIG. 5 another embodiment of the device is illustrated. In this embodiment the device is formed into an intake manifold gasket 25 for a four cylinder engine showing suitable bores 26 for intake manifold bolts and demonstrating that the device is envisioned as being capable of being utilized in an engine with any number of cylinders. The embodiment of FIG. 5 may be constructed of relatively thin sheet metal with or without gasketing material, or with or without embossing of the metal, to improve the sealing effect when functioning as the intake manifold gasket. The blades 2 and 3 depicted in FIG. 5 require that they be of sufficient rigidity in the sheet metal to eliminate any possible distortion during operation. The additional functioning of the device as an engine intake manifold gasket is readily understood by one skilled in the art. As depicted in FIG. 5, the device could be manufactured by a stamping or pressing operating, making the invention readily available to replace existing automobile manufacturers' original equipment. By removing the intake manifold from the engine and installing the embodiment of FIG. 5, the user effectively incorporates the device on multiple cylinders in one easy step. Again, as in other illustrations of the invention, FIG. 5 shows only two blades 2 and 3 for each cylinder bore. It is disclosed that more blades could be employed to accommodate different engine needs. The blades 2 and 3 shown in FIG. 5 are helically twisted and positioned relative to the flow path at the same angles discussed in the paragraph above describing FIG. 1.

Figure 6:
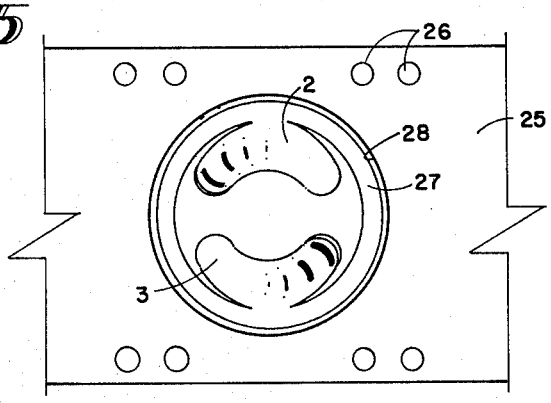
FIG. 6 is a plan view of an embodiment of the device functioning as an insert to a modified intake manifold gasket.

In FIG. 6, the invention is shown as an insert 27 to a modified intake manifold gasket 25 wherein the intake manifold gasket 25 is cut with an oversized bore 28 in the opening to any of the cylinders, and the device depicted in FIG. 6 would be inserted in the location where the intake manifold gasket bore 28 is oversized, forming a complete gasket unit. This embodiment enables the user to selectively place the invention in the flow path of cylinders which require, for whatever reason, additional mixing of the fuel/air mixture which additional mixing is not required in another cylinder. The intake manifold gasket 25 may be of any type commonly used in the field. By enlarging or oversizing the intake manifold port bore oversize 28, the sealing function of gasket is not impaired and the placement of the insert 27 fills the void created by the oversizing. As in all other embodiments shown above, the helically twisted blades 2 and 3 can be multiplied to suit a particular engine need. Further, the blades are twisted and positioned relative to the flow path as the same angles discussed in the paragraph above describing FIG. 1.

To retro-fit existing engines to incorporate the structural device embodiment in FIG. 6, the engine intake manifold is removed as is the intake manifold gasket. The intake port opening in the intake manifold gasket is bored oversized to accommodate the embodiment of FIG. 6. The manifold and engine head mating surfaces are cleaned to assure a positive seal upon reinstalling of gasket and intake manifold. The engine intake manifold gasket with the over-sized intake port opening is reinstalled and the embodiment of FIG. 6 is placed inside of the oversized intake port opening. The engine intake manifold is then reinstalled.

Figure 7:
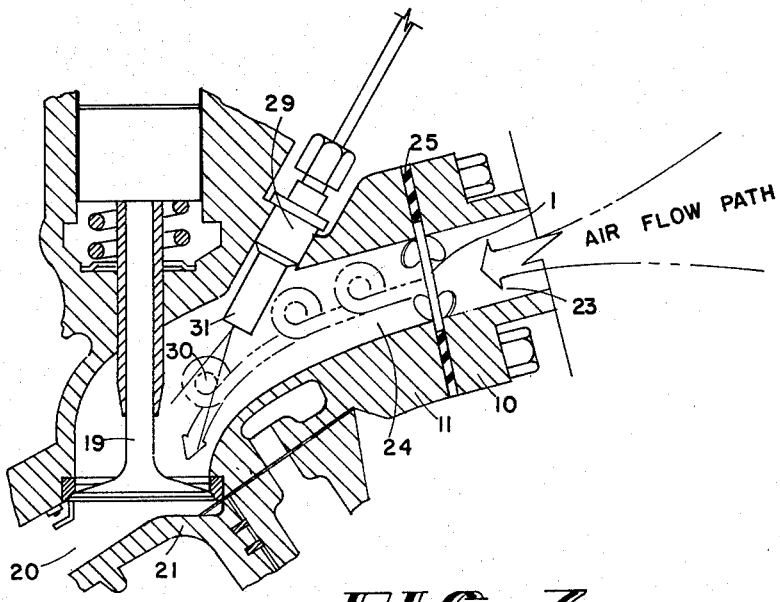
FIG. 7 is an axial section showing an embodiment of the device in the flow line of a fuel injection type engine.

FIG. 7 illustrates the application of the invention to a fuel-injected engine. As can be seen from this figure, the invention 1 functions to increase the turbulence of the air flow in the intake port, creating a better mixing effect with the injected fuel. FIG. 7 shows an embodiment of the device 1 and the gasket 25 are an integral unit as disclosed in FIGS. 3, 5, and 6. In fuel injected systems, the injector 29 functions to atomize a continuous or intermittent flow of fuel that is injected under pressure into the intake port 24 of the engine. The pressurized fuel is discharged in an umbrella pattern 30 as a result of the injector nozzle 31 design. The injected fuel mists upon the intake valve 19. With the present invention operatively dispositioned between the intake manifold 10 and the engine head 11, the air flowing through the intake manifold passage 23 impacts upon the present invention 1 causing violent swirling of the air flow as described in the preceding paragraphs. The swirling air then encounters the umbrella mist 30 from the injector nozzle 31 resulting in mixing of the air and injected fuel mixture. In situations where the injector nozzle 31 is experiencing partial clogging, the additional mixing created by the present invention 1 reduces and eliminates burning or eroding of the intake valve 19. The improved fuel/air mixture flows into the cylinder 20 when the intake valve 19 opens. Upon the compression stroke of the piston, the fuel/air mixture is exploded.

As will be apparent to one skilled in the art, the present invention requires little skill for installation and little or no maintenance because there are no moving parts.

The method for installing the present invention in engines having fuel injection systems, does not necessitate any disruption of the injector in the intake port. The user removes the engine intake manifold (also called an intake air distributor) from the engine head. The existing intake manifold gaskets are removed, and the manifold and head mating surfaces are cleaned to ensure proper sealing when the intake manifold is reinstalled. Any embodiment of the present invention is then installed between the engine head at the intake port and the intake manifold. Lastly, the intake manifold is reinstalled.

While the invention has been described in connection with the preferred embodiment, it is not intended to limit the invention to the particular forms set forth, but, on the contrary, it is intended to cover such alternatives, modifications and equivalents as may be included within the spirit and scope of the invention as defined by the appended claims.

I claim:

1. A device for improving fuel/air mixing in an internal combustion engine comprising:

at least two helically twisted blades positioned in an inner bore of an intake port opening, said helically twisted blades being attached to the inner circumference of an opening in an intermediate member operatively dispositioned between an engine intake manifold and an intake port, said helically twisted blades extending into a portion of an intake manifold passage and also extending into a portion of an intake port passage;

said helically twisted blades angled between 30° and 60° in relation to a fuel/air flow path through said inner bore and said intermediate member;

said helically twisted blades having leading edges at an angle greater than 20°, but less than 60° to trailing edges of said helically twisted blades.

2. The device of claim 1 wherein a face of said helically twisted blades is a partial sine wave configuration.

3. The device of claim 2 wherein said intermediate member is a manifold alignment ring.

4. The device of claim 2 wherein said intermediate member is an engine intake manifold gasket.

5. The device of claim 4 wherein said engine intake manifold gasket has multiple bores corresponding to each intake port in a multi-cylinder engine.

6. A device for improving fuel/air mixing in an internal combustion engine incorporating a fuel injection system comprising:

at least two helically twisted blades positioned in an inner bore of an intake port opening;

said helically twisted blades being attached to the inner circumference of an opening in an intermediate member operatively dispositioned in an oversized intake manifold port opening in an engine intake manifold gasket;

said intake manifold gasket being positioned between an engine intake manifold and an intake port;

said helically twisted blades extending into a portion of an engine intake manifold passage and also extending into a portion of an intake port passage and being generally angled at 45° in relation to an air flow path through said inner bore and said intermediate member;

said helically twisted blades having leading edges being generally angled at 45° to trailing edges of said helically twisted blades;

said helically twisted blades having a face in a partial sine wave configuration.

7. A method for retro-fitting an internal combustion engine for improved fuel/air mixing comprising the following steps:

a first removing of an engine intake manifold;

a second removing of an engine intake manifold gasket;

cleaning said engine intake manifold and an engine head on which said engine intake manifold gasket was mounted to provide smooth mating surfaces;

installing a device for improving fuel/air mixing, said device comprising at least two helically twisted blades positioned in an inner bore of an intake port opening, said helically twisted blades being attached to the inner circumference of an opening in an intermediate member being secured between the engine intake manifold and intake port, said helically twisted blades extending into a portion of an engine intake manifold passage and also extending into a portion of an intake port passage and being angled between 30° and 60° in relation to a fuel/air flow path through said inner bore of said intake port opening;

said helically twisted blades having leading edges at an angle greater than 20° but less than 60° to trailing edges of said helically twisted blades;

first reinstalling of said engine intake manifold gasket;

second reinstalling of said engine intake manifold.

8. The method of claim 7 including shaping a face of said blades in a partial sine wave configuration.

9. A method for retro-fitting an internal combustion engine for improved fuel/air mixing comprising the following steps:

a first removing of an engine intake manifold;

a second removing of an engine intake manifold gasket;

a third removing of a manifold alignment ring;

cleaning said engine intake manifold and an engine head on which said engine intake manifold gasket was mounted to provide smooth mating surfaces;

a first reinstalling of said engine intake manifold gasket;

a second reinstalling of a modified manifold alignment ring for improving fuel/air mixing, said modified manifold alignment ring comprising at least two helically twisted blades, said helically twisted blades being attached to the inner circumference of said modified manifold alignment ring and being located in an inner bore of an intake port opening by said modified manifold alignment ring, said modified manifold alignment ring being secured between said engine intake manifold and said intake port opening, said helically twisted blades extending into a portion of an engine intake manifold passage and also extending into a portion of an intake port passage and being angled between 30° and 60° in relation to a fuel/air flow path through said inner bore of said intake port opening, said helically twisted blades having leading edges at an angle greater than 20°, but less than 60° to trailing edges of said helically twisted blades;

a third reinstalling of said engine intake manifold.

10. The method for retro-fitting an internal combustion engine as recited in claim 8 wherein said intermediate member includes gasket means with opening therein for alignment with said inner bore, said gasket means having said helically twisted blades forming a part thereof and being positioned in said opening.

* * * * *